United States Patent [19]

Kimball et al.

[11] Patent Number: 4,550,270

[45] Date of Patent: Oct. 29, 1985

[54] TUNGSTEN HALOGEN LAMP HAVING A FINE-WIRE FILAMENT AND A HYDROGEN-IMPERVIOUS ENVELOPE

[75] Inventors: Stephen F. Kimball, No. Andover; Emery G. Audesse, Beverly; Robert M. Griffin, So. Hamilton, all of Mass.

[73] Assignee: GTE Products Corporation, Stamford, Conn.

[21] Appl. No.: 490,603

[22] Filed: May 2, 1983

[51] Int. Cl.[4] ..... H01K 1/08

[52] U.S. Cl. ..... 313/579; 313/557

[58] Field of Search ..... 313/579, 559, 557

[56] References Cited

U.S. PATENT DOCUMENTS 3,418,512 12/1968 Jampens et al. ..... 313/579

4,451,760 5/1984 Griffin et al. ..... 313/579

*Primary Examiner*—D. K. Moore

*Attorney, Agent, or Firm*—Joseph S. Romanow; William H. McNeill

[57] ABSTRACT

This invention provides a tungsten-halogen lamp having a thin-wire filament and a hydrogen-impervious envelope. Containment of hydrogen within the lamp envelope suppresses tungsten corrosion of the filament and prevents early termination of the lamp. In the preferred embodiment, an aluminosilicate glass is employed as the hydrogen-impervious envelope material. This invention overcomes a substantial impediment in the development of a feasible tungsten-halogen lamp as a replacement for the standard Edison-type lamp for general lighting purposes.

4 Claims, 2 Drawing Figures

TUNGSTEN HALOGEN LAMP HAVING A FINE-WIRE FILAMENT AND A HYDROGEN-IMPERVIOUS ENVELOPE

TECHNICAL FIELD

This invention relates to tungsten-halogen lamps and more particularly to such lamps having a fine-wire filament and an envelope which is impervious to hydrogen.

BACKGROUND ART

Tungsten-halogen lamps, because of their superior performance characteristics, are being carefully considered by various lamp manufacturers as a possible replacement for Edison-type lamps for general lighting purposes. A major impediment in the path of providing a feasible tungsten-halogen replacement is the problem of short lamp life. A tungsten-halogen lamp having a power rating of 150 watts or less and operating with approximately 120 volts of alternating current requires a lamp filament with a relatively thin diameter in order to attain reasonable luminous efficacy.

In experimental low-wattage line-voltage lamps constructed under the existing art, the fine-wire filament is readily attacked by the halogen in the fill causing premature lamp failure and unacceptably short lamp life.

The tungsten-halogen regenerative cycle is well known. In lamps having a fill comprising a halogen and hydrogen, it is known that permeation of hydrogen through the envelope walls has a detrimental effect on lamp life. As the hydrogen diffuses through the walls, more of the halogen becomes free to attack and corrode the cooler portions of the lamp filament and other internal lamp parts. This corroding effect eventually destroys the lamp filament, usually at the ends of the filament or near the filamentary supports.

The corrosion problem is particularly acute in circumstances where fine-wire filaments are desired. A fine-wire filament will be destroyed more rapidly by corrosion because of its small mass per unit of length.

There is no low-wattage line-voltage tungsten-halogen lamp for general lighting purposes presently available in the consumer market. The inability to overcome the problem of corrosion and rapid destruction of a thin-wire filament is a major impediment in the path of developing a feasible replacement for the standard Edison-type lamp.

DISCLOSURE OF THE INVENTION

It is, therefore, an object of this invention to obviate the deficiencies in the prior art.

It is another object of this invention to provide a tungsten-halogen lamp having a thin-wire filament which substantially overcomes the problem of premature lamp failure caused by rapid filamentary corrosion.

It is a further object of this invention to provide a tungsten-halogen lamp for general lighting purposes which is a feasible replacement for standard Edison-type lamps.

These objects are accomplished, in one aspect of the invention, by the provision of a tungsten-halogen lamp comprising an envelope enclosing a hermetically sealed cavity, the envelope being impervious to hydrogen. Within the hermetically sealed cavity, a fine-wire filament comprising tungsten is operatively mounted. The diameter of the fine-wire filament is approximately 0.003 inches or less. A fill comprising a halogen and hydrogen is provided within the hermetically sealed cavity.

Tungsten-halogen lamps constructed as herein described will not experience rapid filamentary corrosion as has been the case with fine-wire laboratory lamps constructed under the existing art.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Figure 1:
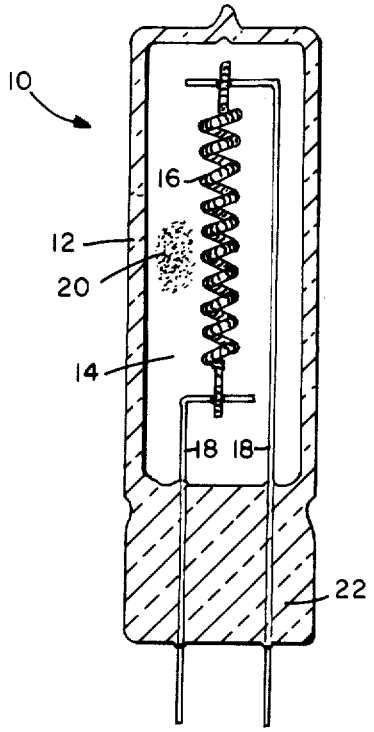
FIG. 1 is an elevational view of one embodiment of the invention.

Referring to the drawings with greater particularity, FIG. 1 is an elevational view of a tungsten-halogen lamp 10 comprising envelope 12 enclosing hermetically sealed cavity 14. Envelope 12 is impervious to hydrogen. Fine-wire filament 16 comprising tungsten is operatively mounted within cavity 14, e.g., by crimping each end of filament 16 to the internal terminations of lead-in wires 18. The diameter of filament 16 is approximately 0.003 inches or less. Fill 20 is contained within cavity 14. Fill 20 comprises a halogen and hydrogen.

Lamp 10 will not experience rapid filamentary corrosion. Because envelope 12 is impervious to hydrogen, the hydrogen in fill 20 will be substantially contained within cavity 14 during the operating life of lamp 10. When hydrogen is present in fill 20, the halogen remains substantially bound to hydrogen or to tungsten. Consequently, there is little or no free halogen available to react with and corrode filament 16.

In the halogen regenerative cycle, the halogen combines with tungsten evaporated from the filament and transports the tungsten back to the vicinity of the extremely hot filament whereupon the tungsten-halogen compound dissociates and the tungsten is redeposited on the filament or lead wires. When the halogen is not combined with tungsten in the cycle, it is advantageous for the halogen to be bound with the hydrogen in the fill. The halogen in elemental form, so-called "free" halogen, will attack and corrode the cooler portions of the tungsten filament via the same reaction as occurs in the transport part of the cycle. In order to prevent the production of free halogen, an ample supply of hydrogen must be available in the fill. The use of a hydrogen-impervious envelope insures that ample hydrogen will be available so that the halogen regenerative cycle will occur with minimal production of free halogen.

End-of-life of a tungsten-halogen lamp is considered to be "normal" when the cause of lamp failure is tungsten evaporation from the filament. When tungsten-halogen lamps are constructed in accordance with this invention, the mean lamp life is comparable to that generally experienced with tungsten evaporation; the retention of hydrogen about the fine-wire filament suppresse rapid filamentary corrosion. Although lamp failure may ultimately be attributable to filamentary corrosion, the corrosive reaction about a fine-wire filament has been slowed to the point that the mean lamp life is feasible for a consumer product.

As used herein, the term halogen means iodine, bromine, chlorine, or florine, or any combination of such elements.

Envelope 12 may be any light-transmissive material which is impervious to hydrogen and is otherwise suited to the internal operating environment of lamp 10. In the preferred embodiment of the invention, envelope 12 comprises an aluminosilicate glass. In an alternate embodiment, envelope 12 comprises a borosilicate glass.

Most tungsten-halogen lamps in the existing art use quartz or Vycor as the envelope material. Both of these glasses have excellent high-temperature characteristics and are relatively devoid of contaminants which might impair the halogen regenerative cycle. However, quartz and Vycor are permeable by hydrogen. When quartz or Vycor envelopes are employed with a heavy-wire tungsten filament, the filamentary corrosion has a minor effect on lamp life. When quartz or Vycor envelopes are employed with a fine-wire tungsten filament, the filamentary corrosion reduces lamp life to the extent that the lamp is not feasible as a consumer product. On the other hand, use of an aluminosilicate or a borosilicate glass as the envelope material with a fine-wire filament provides a lamp wherein the mean lamp life is comparable to that of lamps having substantially heavier filaments. Thus, the use of a hydrogen-impervious envelope overcomes the problem of an unacceptably short lamp life in a lamp having a fine-wire filament.

The use of an aluminosilicate or a borosilicate glass as the envelope material provides an economic benefit, because these hard glasses are substantially less costly than quartz or Vycor.

Filament 16 is a thin wire comprising tungsten. For purposes herein, the terms "thin" or "thin-wire" mean a wire having a diameter of approximately 0.003 inches or less. The form, size, and support means for filament 16 may vary with differing service requirements. In the preferred embodiment, filament 16 is a coiled coil with two filamentary supports at the internal terminations of lead-in wires 18.

Figure 2:
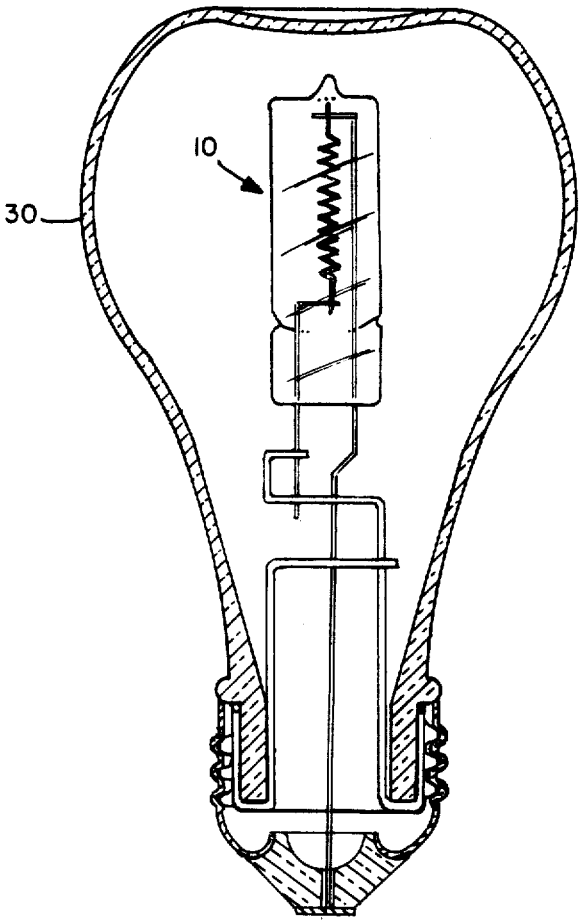
FIG. 2 is an elevational view of an alternate embodiment of the invention.

FIG. 2 shows an alternate embodiment of the invention wherein lamp 10 is operatively mounted within outer envelope 30.

In laboratory examples of the invention as shown in FIG. 1, envelope 10 was formed from T5 (0.624 inch diameter by 0.04 inch wall-thickness) Corning 1720 aluminosilicate glass. Filament 16 comprised tungsten (100 watt/120 volt/17.5 lumens per watt efficacy) wire having an approximately 0.003 inch diameter formed into a coiled coil. Lead-in wires 18 were molybdenum plus 3% tantalum. The hermetic seal was achieved by means of a press seal 22 enclosing lead-in wires 18. Fill 20 comprised 98% krypton, 1.88% nitrogen, and 0.12% hydrogen bromide at a pressure of 7 atmospheres absolute at room temperature. In the laboratory examples, the mean lamp life was approximately 2200 hours.

While there have been shown what are at present considered to be preferred embodiments of the invention, it will be apparent to those skilled in the art that various changes and modifications can be made herein without departing from the scope of the invention as defined by the appended claims.

We claim:

1. A tungsten-halogen lamp comprising:

(a) an envelope enclosing a hermetically sealed cavity, said envelope being impervious to hydrogen;

(b) a fine-wire filament comprising tungsten operatively mounted within said hermetically sealed cavity, said fine-wire filament having a diameter of approximately 0.003 inches or less; and (c) a fill within said hermetically sealed cavity, said fill comprising a halogen and hydrogen.

2. The tungsten-halogen lamp of claim 1 wherein said envelope comprises glass selected from the group consisting of aluminosilicate and borosilicate glasses.

3. The tungsten-halogen lamp of claim 1 wherein said tungsten-halogen lamp is operatively mounted within an outer envelope.

4. The tungsten-halogen lamp of claim 2 wherein said tungsten-halogen lamp is operatively mounted within an outer envelope.

* * * * *

US004550270B1

REEXAMINATION CERTIFICATE (2770th)

United States Patent [19]

Kimball et al.

[11] B1 4,550,270

[45] Certificate Issued Jan. 9, 1996

[54] TUNGSTEN HALOGEN LAMP HAVING A FINE-WIRE FILAMENT AND A HYDROGEN-IMPERVIOUS ENVELOPE

[75] Inventors: Stephen F. Kimball, No. Andover; Emery G. Audesse, Beverly; Robert M. Griffin, So. Hamilton, all of Mass.

[73] Assignee: GTE Products Corporation, Stamford, Conn.

Reexamination Request:
No. 90/003,704, Jan. 27, 1995

Reexamination Certificate for:

| | |
|---|---|
| Patent No.: | **4,550,270** |
| Issued: | **Oct. 29, 1985** |
| Appl. No.: | **490,603** |
| Filed: | **May 2, 1983** |

[51] Int. Cl.[6] ..... H01K 1/08

[52] U.S. Cl. ..... 313/579; 313/557

[58] Field of Search ..... 313/579, 559, 313/557, 580, 633

[56] References Cited

U.S. PATENT DOCUMENTS

| | | | |
|---|---|---|---|
| 3,243,634 | 3/1966 | Mosby . | |
| 3,829,729 | 8/1974 | Westlund, Jr. et al. | 313/174 |
| 4,366,409 | 12/1982 | Nieda et al. | 313/221 |

FOREIGN PATENT DOCUMENTS

| | | |
|---|---|---|
| 0019850 | 12/1980 | European Pat. Off. . |
| 2416860 | 10/1974 | Germany . |

*Primary Examiner*—Donald J. Yusko

[57] ABSTRACT

This invention provides a tungsten-halogen lamp having a thin-wire filament and a hydrogen-impervious envelope. Containment of hydrogen within the lamp envelope suppresses tungsten corrosion of the filament and prevents early termination of the lamp. In the preferred embodiment, an aluminosilicate glass is employed as the hydrogen-impervious envelope material. This invention overcomes a substantial impediment in the development of a feasible tungsten-halogen lamp as a replacement for the standard Edison-type lamp for general lighting purposes.

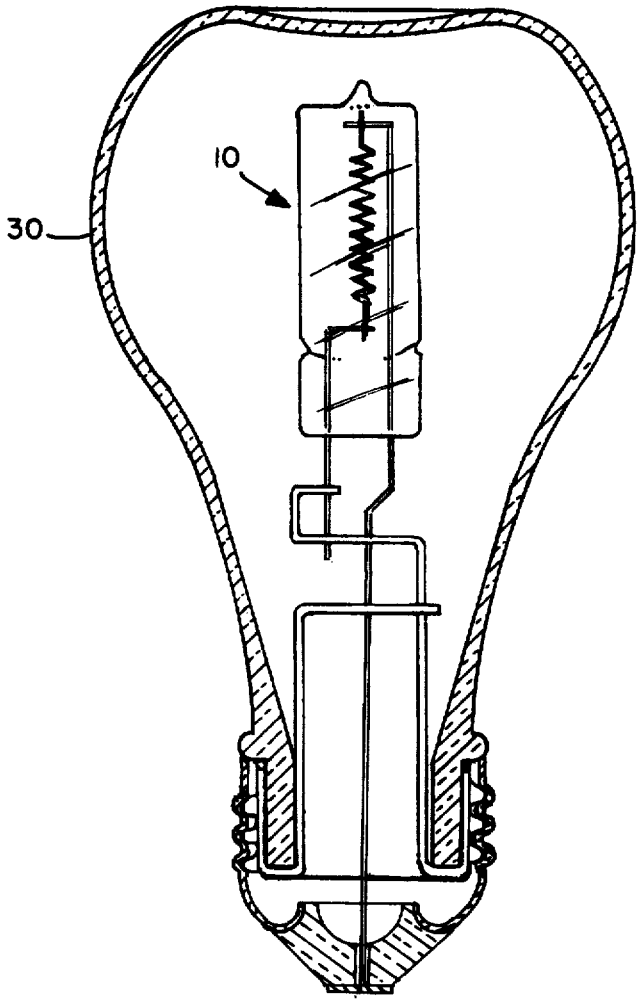

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 57–68:

End-of-life of a tungsten-halogen lamp is considered to be "normal" when the cause of lamp failure is tungsten evaporation from the filament. When tungsten-halogen lamps are constructed in accordance with this invention, the mean lamp life is comparable to that generally experienced with tungsten evaporation; the retention of hydrogen about the fine-wire filament [suppresse] *suppresses* rapid filamentary corrosion. Although lamp failure may ultimately be attributable to filamentary corrosion, the corrosive reaction about a fine-wire filament has been slowed to the point that the mean lamp life is feasible for a consumer product.

Column 3, lines 1–3:

As used herein, the term halogen means iodine, bromide, chlorine, or [florine] *fluorine*, or any combination of such elements.

AS A RESULT OF REEXAMINATION, IT HAS BEEN DETERMINED THAT:

Claim 1 is determined to be patentable as amended.

Claims 2–4, dependent on an amended claim, are determined to be patentable.

New Claims 5–9 are added and determined to be patentable.

1. A tungsten-halogen lamp comprising:

(a) an envelope enclosing a hermetically sealed cavity, said envelope being impervious to hydrogen;

(b) a fine-wire filament comprising tungsten operatively mounted with said hermetically sealed cavity, said fine-wire filament having a diameter of approximately 0.003 inches or less, *said lamp being operable on line voltage, having a power rating of 150 watts or less and having an acceptably long mean lamp life*; and (c) a fill within said hermetically sealed cavity, said fill comprising a halogen and hydrogen.

*5. The tungsten-halogen lamp of claim 1 wherein said tungsten-halogen lamp operates at approximately 120 volts.*

*6. The tungsten-halogen lamp of claim 1 wherein said tungsten-halogen lamp has a power rating of 100 watts.*

*7. The tungsten-halogen lamp of claim 1 wherein said tungsten-halogen lamp has an efficacy of 17.5 lumens per watt.*

*8. The tungsten-halogen lamp of claim 1 wherein said tungsten-halogen lamp has a mean lamp life of approximately 2200 hours.*

*9. The tungsten-halogen lamp of claim 1 wherein said halogen is bromine.*

* * * * *